US007677856B2

(12) United States Patent
Standal

(10) Patent No.: US 7,677,856 B2
(45) Date of Patent: Mar. 16, 2010

(54) DRILL FLOOR DEVICE

(75) Inventor: Trond Standal, Kristiansand (NO)

(73) Assignee: National Oilwell Norway AS (NO)

( * ) Notice: Subject to any disclaimer, the term of this patent is extended or adjusted under 35 U.S.C. 154(b) by 13 days.

(21) Appl. No.: 12/089,484

(22) PCT Filed: Oct. 11, 2006

(86) PCT No.: PCT/NO2006/000352

§ 371 (c)(1),
(2), (4) Date: Apr. 7, 2008

(87) PCT Pub. No.: WO2007/043891

PCT Pub. Date: Apr. 19, 2007

(65) Prior Publication Data

US 2008/0296065 A1 Dec. 4, 2008

(30) Foreign Application Priority Data

Oct. 12, 2005 (NO) ..... 20054697

(51) Int. Cl.
*E21B 19/00* (2006.01)

(52) U.S. Cl. ..... 414/22.63; 175/52; 175/85; 166/85.5

(58) Field of Classification Search ..... 414/22.66, 414/22.63, 22.51; 166/77.51, 52
See application file for complete search history.

(56) References Cited

U.S. PATENT DOCUMENTS

| | | | | |
|---|---|---|---|---|
| 3,689,060 A | | 9/1972 | Hensley, Jr. | |
| 3,981,369 A | | 9/1976 | Bokenkamp | |
| 4,050,590 A | * | 9/1977 | Benjamin | 414/22.53 |
| 4,708,563 A | * | 11/1987 | Van Den Berg et al. | 414/22.66 |
| 5,351,767 A | * | 10/1994 | Stogner et al. | 175/162 |
| 5,468,121 A | | 11/1995 | Stogner | |
| 6,343,892 B1 | * | 2/2002 | Kristiansen | 405/195.1 |
| 6,513,605 B1 | * | 2/2003 | Lodden | 175/52 |

FOREIGN PATENT DOCUMENTS

| | | | |
|---|---|---|---|
| EP | 0449710 A2 | | 10/1991 |
| EP | 1103696 A2 | | 5/2001 |
| GB | 1558172 A | | 12/1979 |
| WO | 2006059910 A1 | | 6/2006 |
| WO | WO 2006059910 A1 | * | 6/2006 |
| WO | 2006096068 A1 | | 9/2006 |

OTHER PUBLICATIONS

International Search Report for parent application PCT/NO2006/000352, having a mailing date of Jan. 19, 2007.

* cited by examiner

*Primary Examiner*—Jennifer H Gay
*Assistant Examiner*—Kipp C Wallace
(74) *Attorney, Agent, or Firm*—Conley Rose, P.C.

(57) ABSTRACT

A drill floor device has two or more mouseholes for assembly and disassembly of pipe string sections. The mouseholes are arranged to be displaced underneath the drill floor by a drive system and positioned under a hole or an opening in the drill floor. At least one of the mouseholes is provided with an elevator arranged to raise and lower a pipe or a pipe string section located in the mousehole, between an upper working position in which the upper end of the pipe/pipe string section projects above the drill floor and a lower position of rest in which the upper end of the pipe/pipe string section is below the drill floor.

4 Claims, 3 Drawing Sheets

DRILL FLOOR DEVICE

CROSS-REFERENCE TO RELATED APPLICATIONS

This application is the U.S. national stage application of International Application No. PCT/NO2006/000352, filed Oct. 11, 2006, which International application was published on Apr. 19, 2007, as International Publication No. WO 20071043891 A1 in the English language, which application is incorporated herein by reference. The International application claims priority of Norwegian Patent Application No. 20054697, filed Oct. 12, 2005, which application is incorporated herein by reference.

The present invention regards a device for a drill floor where pipes are assembled to form a pipe string section, and where pipes in a pipe string section are dismantled.

The operation of constructing a pipe string from pipes and running the pipe string into a borehole or a well and the operation of retrieving a pipe string from a borehole or a well and dismantling the pipes in the pipe string, are performed primarily from a drill floor. The pipe ends are provided with threads, and the pipes are assembled and disassembled by screwing. The screwing operation is performed by use of motor-driven tools.

The work process is made more efficient by moving some screwing operations and handling of single pipes away from the central area of the drill floor, i.e. away from the centre of the borehole or well.

This is achieved by first assembling a few pipes, e.g. three or four pipes, into a pipe string section or stand outside of the central assembly area, which is then brought to the central assembly area to be included in the pipe string, possibly via intermediate storage. Similarly, a pipe string is dismantled by first being split into stands, each of which consists of several pipes. Each stand is transported away from the central assembly area for further disassembly. With this, the screwing operations are divided between two assembly areas on the drill floor; a central assembly area near the centre of the borehole or well and a non-central assembly area.

Typically, pipes and stands are placed in a so-called mousehole in the drill floor in connection with screwing operations carried out outside of the central area.

A mousehole comprises a substantially vertical tubular casing open at the upper end and provided with a pipe support below the upper end of the casing, e.g. in the form of an end plate/bottom plate at the lower end of the casing. The mousehole is installed under the drill floor and is concentric with an opening, a hole, in the drill floor. The depth of the mousehole is determined by the positioning of the pipe support. A mousehole may be made shallower by placing a spacer at the bottom, so that the spacer rests on the pipe support.

In a known operation for assembling four pipes into a four-pipe stand, a first pipe is placed in a shallow mousehole. A second pipe is brought to a vertical position above the first pipe, lowered into threaded contact with the first pipe, and the two pipes are screwed together to form a first two-pipe stand, by use of a tool located by the mousehole. The first two-pipe stand is lifted out of the mousehole and placed in intermediate storage while a second two-pipe stand is constructed in the mousehole. The second two-pipe stand is transferred into a deeper mousehole, so that the upper end of the second two-pipe stand can be positioned at a suitable working height above the drill floor. The first two-pipe stand is retrieved from intermediate storage and added to the top of the stand in the mousehole, whereupon a finished four-pipe stand is lifted out of the mousehole and brought to the central assembly area of the drill floor or placed in intermediate storage.

In a similar known operation for disassembly of a drill string, it is first split into four-pipe stands in the central area of the drill floor. Each four-pipe stand is then, optionally via intermediate storage, brought to the deeper mousehole, where the stand is dismantled into two two-pipe stands. Each two-pipe stand is then, optionally via intermediate storage, brought to a shallow mousehole in which the stand is dismantled into single pipes.

A drawback of the known solution is that it requires some readjustments when changing between mouseholes of different depths.

The object of the invention is to provide a device which eliminates said drawback.

The object is achieved by characteristics as stated in the description below and in the following claims.

According to the invention, the drill floor is provided with several mouseholes which can be displaced horizontally underneath the drill floor, and where the pipe support in at least one mousehole is provided with an elevator that can raise and lower the pipe support, thus altering the depth of the mousehole.

Increasing the depth of the mousehole allows a pipe or a stand located in the mousehole to be lowered to a lower position of rest where the upper end of the pipe/stand is below the drill floor. An empty mousehole, or a mousehole where a pipe or a stand has been lowered as indicated, may be moved horizontally underneath the drill floor, as mentioned above. Positioning a mousehole containing a lowered pipe or a lowered stand under an opening in the drill floor and then making the mousehole shallower by raising the pipe support, allows the upper end of the pipe/stand to be brought to a working height above the drill floor.

By use of the invention a three-pipe stand can be constructed in the following way. An empty first mousehole is positioned under an opening in the drill floor, and a first single pipe is brought to a vertical position through the opening and placed in the mousehole, by use of previously known equipment. The pipe support of the mousehole is placed at a distance below the drill floor that leaves the upper end of the pipe at a working height above the drill floor, making it easy to disengage the lifting equipment. The depth of the mousehole is increased by lowering the pipe support until the upper end of the pipe is below the drill floor, and the mousehole is displaced horizontally away from the opening in the drill floor. An empty second mousehole is brought into position under the opening in the drill floor, and a second pipe is placed in this second mousehole. A third pipe is brought into the area over the second mousehole and is coupled to the upper end of the second pipe, which projects above the drill floor. This creates a two-pipe stand which is then lifted out of the second mousehole. The now empty second mousehole is displaced horizontally underneath the drill floor away from the opening in the drill floor, and then the first mousehole containing the first pipe is positioned under the opening. The first pipe is raised by means of the elevator and the pipe support, lifting the upper end of the pipe through the opening and up to working height. The two-pipe stand consisting of the second and third pipes is lowered and added to the upper end of the first pipe, whereby a three-pipe stand is created, which is lifted out of the mousehole in the assembled state and placed in intermediate storage or brought to the central area of the drill floor for use in a pipe string. As is evident from the above, it is sufficient for the first mousehole to be provided with a raisable/lowerable pipe support.

A four-pipe stand can be assembled in a similar manner, by using three mouseholes. A first pipe is placed in a first mousehole and displaced away from the opening in the drill floor as explained above. The process is repeated with a second pipe in a second mousehole, which is also displaced away from the opening in the drill floor. A third mousehole is positioned under the opening in the drill floor, and a third and a fourth pipe are assembled into a two-pipe stand which is lifted out of the third mousehole, which is then displace away from the opening in the drill floor. The first or second mousehole, each of which now holds a pipe, is positioned under the opening in the drill floor and the pipe is raised so as to leave the upper end at a working height above the drill floor. The two-pipe stand is added to the upper end of the pipe, creating a three-pipe stand which is lifted out of the mousehole as previously explained. The now empty mousehole is displaced away from the area under the opening in the drill floor, and the mousehole containing the last pipe is positioned under the opening. The last pipe is raised until the upper end is at the working height above the drill floor, and the three-pipe stand is added to the upper end of the pipe, creating a four-pipe stand which is then brought to the central assembly area or placed in intermediate storage.

The mouseholes can easily be mounted to a common slide unit which can be moved back and forth in straight line underneath the drill floor, or they can be mounted to a turret which is rotatable about a centre to the side of the opening in the drill floor. The mouseholes may also be individually displaceable through being mounted to separate slides/turrets.

The arrangement may be expanded by allowing a mousehole to be positioned under several openings in the drill floor. This allows a pipe to be placed in a mousehole through one opening in the drill floor and pulled out of the mousehole through another opening in the floor.

In the following, the invention is described in greater detail by means of an exemplary embodiment, with reference to the appended drawing.

Figure 1:
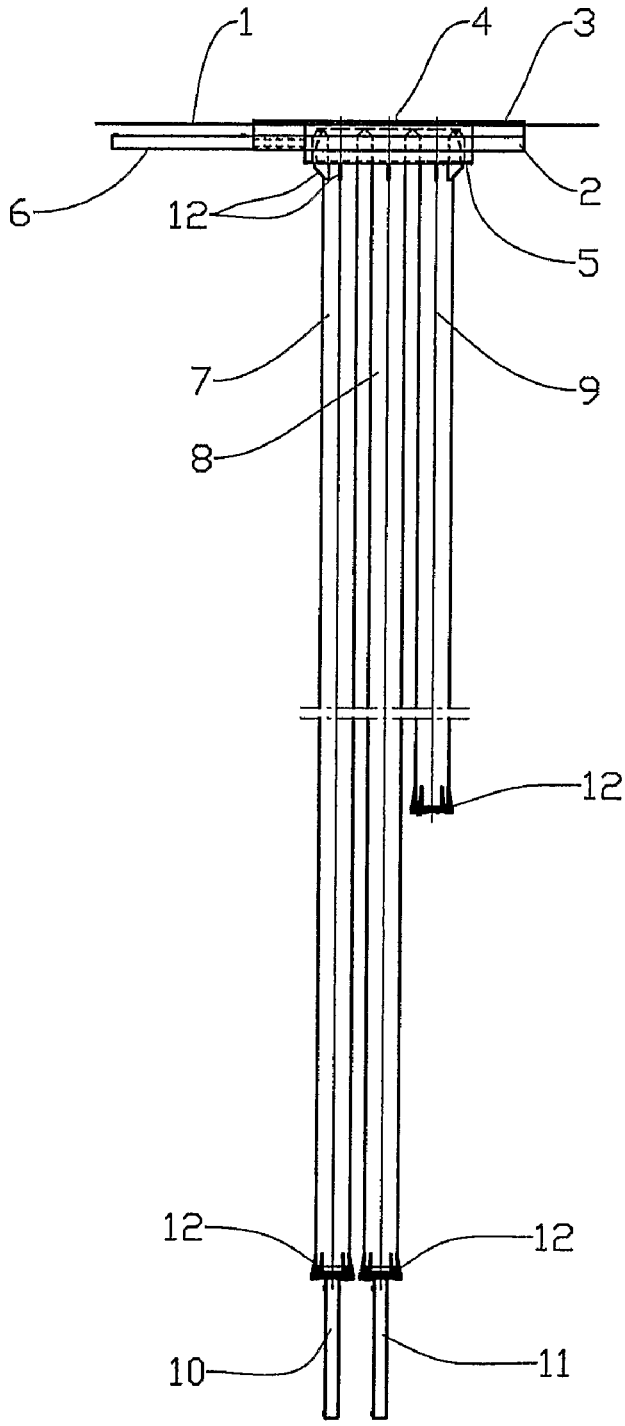
FIG. 1 is a side view of three mouseholes.
Figure 2:
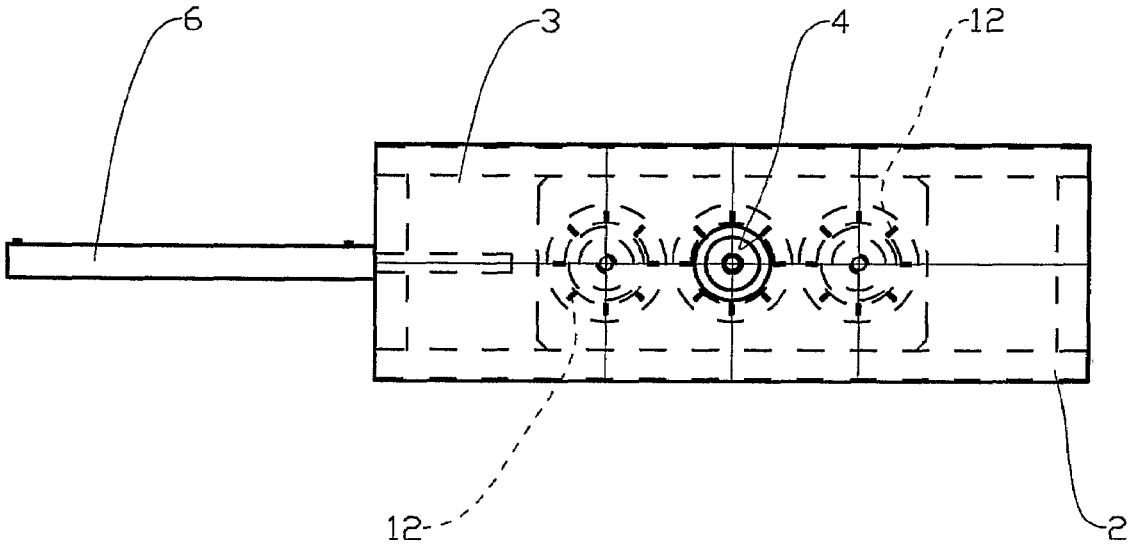
FIG. 2 is a top view of the mouseholes in FIG. 1 on a larger scale.
Figure 3:
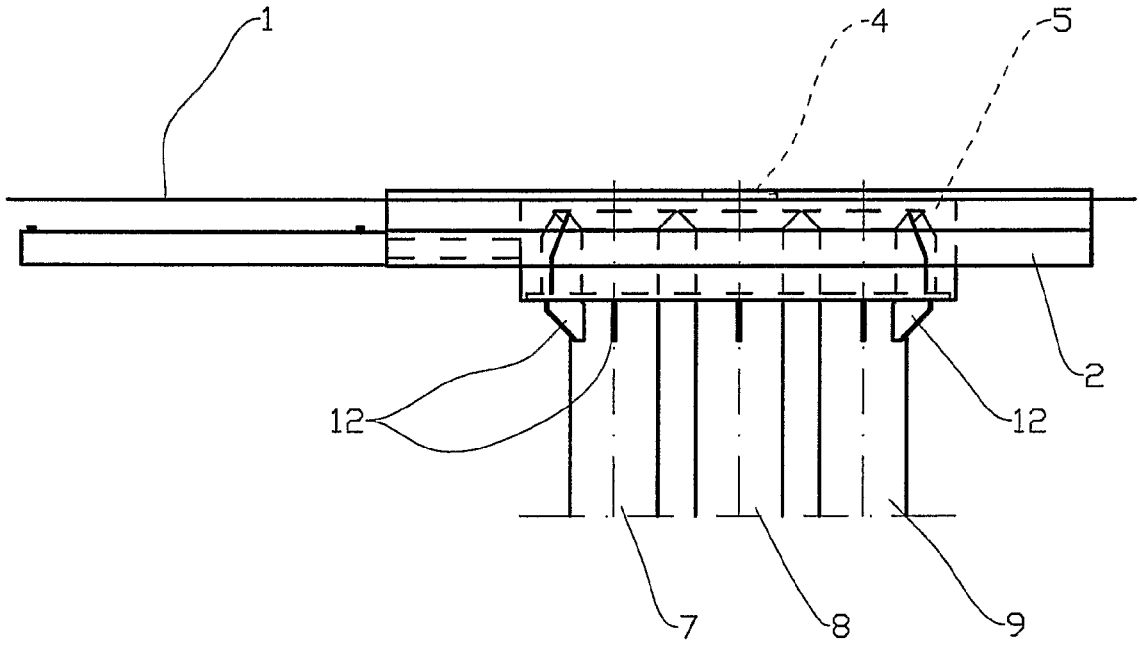
FIG. 3 shows the upper part of the mouseholes of FIG. 1 on a larger scale.

In FIG. 1, reference number 1 denotes a drill floor 1 with a flush-mounted base comprising a frame 2 and a top plate 3 with a hole 4. A carriage 5 is arranged to run in parallel with the drill floor within the frame 2. A drive system 6 comprising a hydraulic cylinder is arranged to move the carriage 5 within the frame 2.

Three mouseholes 7, 8, and 9 are suspended from the carriage 5.

At the lower end of the first mousehole 7 there is provided a first hydraulic cylinder 10 which is arranged to raise and lower a pipe support (not shown) in the first mousehole 7. Similarly, a second hydraulic cylinder 11 is provided at the lower end of the second mousehole 8, which cylinder is arranged to raise and lower a pipe support (not shown) in the second mousehole 8. The third mousehole 9 has a fixed depth.

The mouseholes 7, 8 and 9 may be provided with external ribs 12 and other reinforcements in a manner that is known per se.

The carriage 5 is shown in a position where the second mousehole 8 is located under the hole 4 in the top plate 3. Moving the carriage 5 in the frame 2 by use of the drive system 6 allows selective positioning of mouseholes 7, 8, 9 under the hole 4.

The invention claimed is:

1. A drill floor device comprising two or more mouseholes for assembly and disassembly of pipe string sections stands, wherein the mouseholes are arranged to be displaced underneath the drill floor by a drive system and positioned under a hole or an opening in the drill floor, wherein at least one of the mouseholes is provided with an elevator arranged to raise and lower a pipe or a pipe string section located in the mousehole, between an upper working position in which the upper end of the pipe/pipe string section projects above the drill floor and a lower position of rest in which the upper end of the pipe/pipe string section is below the drill floor.

2. A device in accordance with claim 1, wherein the mouseholes are arranged to be displaced together.

3. A device in accordance with claim 1, wherein a mousehole and the drive system are arranged to be selectively positioned under one or several holes or openings in the drill floor.

4. A device in accordance with claim 2, wherein a mousehole and the drive system are arranged to be selectively positioned under one or several holes or openings in the drill floor.

* * * * *